US008408433B2

(12) United States Patent
Fontana

(10) Patent No.: US 8,408,433 B2
(45) Date of Patent: Apr. 2, 2013

(54) BOTTLE FOR CONTAINING FLUIDS, PARTICULARLY FOR PHARMACEUTICAL PRODUCTS OR THE LIKE

(75) Inventor: Antonio Fontana, Carpi (IT)

(73) Assignee: MRP Medical Research & Promotion Establishment, Vaduz (LI)

( * ) Notice: Subject to any disclaimer, the term of this patent is extended or adjusted under 35 U.S.C. 154(b) by 1037 days.

(21) Appl. No.: 12/309,808

(22) PCT Filed: Feb. 2, 2007

(86) PCT No.: PCT/IB2007/000371

§ 371 (c)(1),
(2), (4) Date: Jan. 30, 2009

(87) PCT Pub. No.: WO2008/015505

PCT Pub. Date: Feb. 7, 2008

(65) Prior Publication Data

US 2009/0321479 A1 Dec. 31, 2009

(30) Foreign Application Priority Data

Aug. 4, 2006 (IT) ..... MO2006A0252

(51) Int. Cl.
*B65D 47/00* (2006.01)

(52) U.S. Cl. ..... 222/547; 222/96; 222/107; 222/213; 222/494; 222/541.5; 222/564

(58) Field of Classification Search ..... 239/333; 222/92, 96, 107, 206–215, 491, 494, 541.5, 222/541.9, 547, 564
See application file for complete search history.

(56) References Cited

U.S. PATENT DOCUMENTS

| | | | | |
|---|---|---|---|---|
| 4,607,764 | A * | 8/1986 | Christine | 222/207 |
| 4,742,928 | A * | 5/1988 | Braun | 215/235 |
| 5,413,250 | A * | 5/1995 | Gueret | 222/105 |
| 5,924,605 | A * | 7/1999 | Baudin et al. | 222/494 |
| 5,975,360 | A * | 11/1999 | Ophardt | 222/83 |
| 6,378,742 | B1 * | 4/2002 | Rohr et al. | 222/494 |
| 6,386,395 | B1 * | 5/2002 | Lunghetti | 222/213 |
| 6,695,173 | B1 * | 2/2004 | Fontana | 222/212 |
| 7,195,138 | B2 * | 3/2007 | Foster et al. | 222/494 |
| 7,198,180 | B2 * | 4/2007 | Foster et al. | 222/494 |
| 7,303,098 | B2 * | 12/2007 | Backes | 222/212 |
| 7,448,559 | B2 * | 11/2008 | Le Maner et al. | 239/463 |

FOREIGN PATENT DOCUMENTS

DE 10157423 6/2003

OTHER PUBLICATIONS

English Abstract of DE 10157423.

* cited by examiner

*Primary Examiner* — Paul R Durand
*Assistant Examiner* — Andrew P Bainbridge
(74) *Attorney, Agent, or Firm* — Young & Thompson

(57) ABSTRACT

A squeezable bottle containing fluids has a mouth for dispensing the fluid. An elastic valve is retained between a closing support retainer and a containment ring. The closing support retainer is secured to the mouth of the bottle and to the elastic valve and has passages for fluid through itself. The containment ring prevents the elastic valve from expanding too far outwardly over at least some of the valve's surface. A fluid passage is formed between the elastic valve and a rigid cap that leads to a dispensing opening. The dispensing opening is sealed by a round disc which is integrally formed with the elastic valve and seats on seat on the cap. This arrangement allows the contents of the bottle to remain sanitary over time.

29 Claims, 3 Drawing Sheets

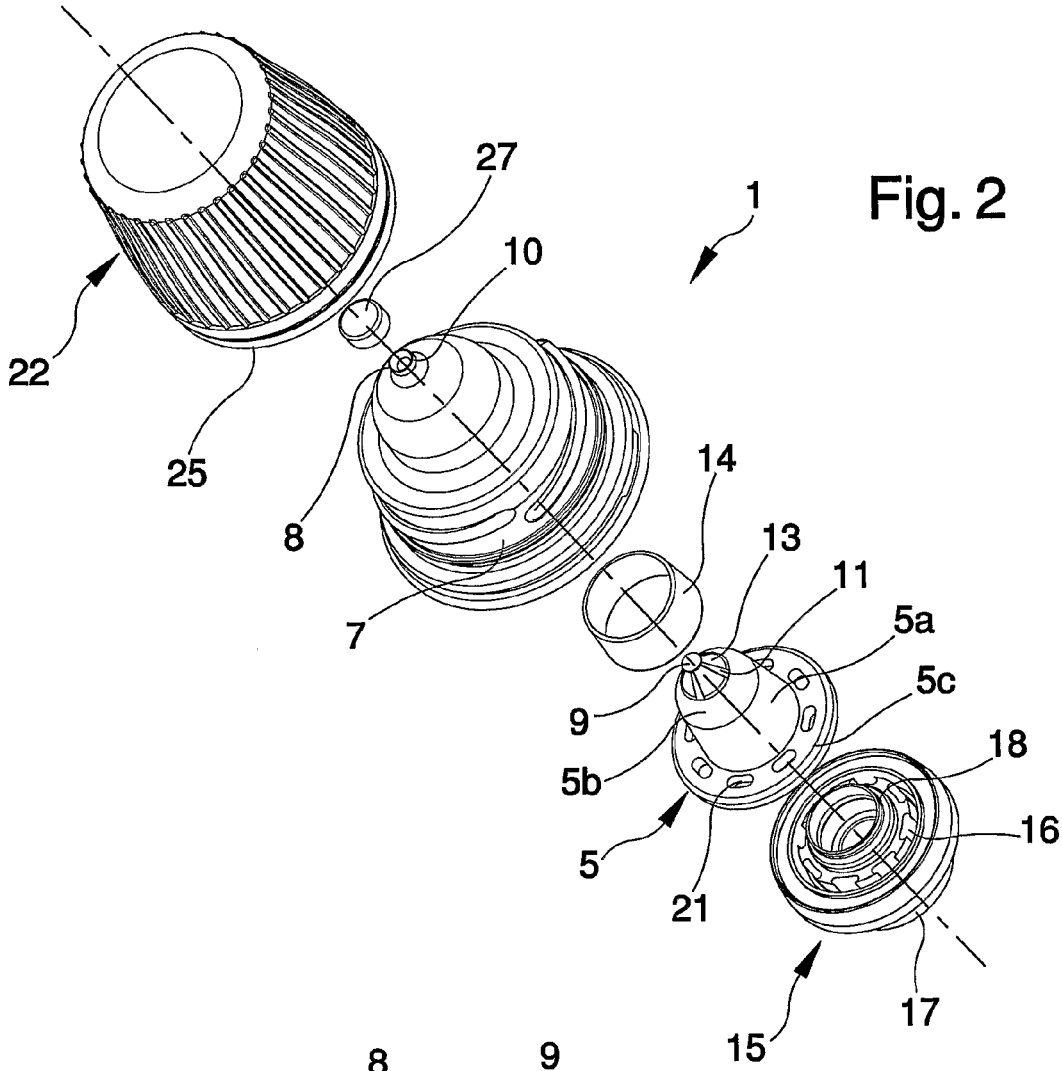
Fig. 2
Fig. 3
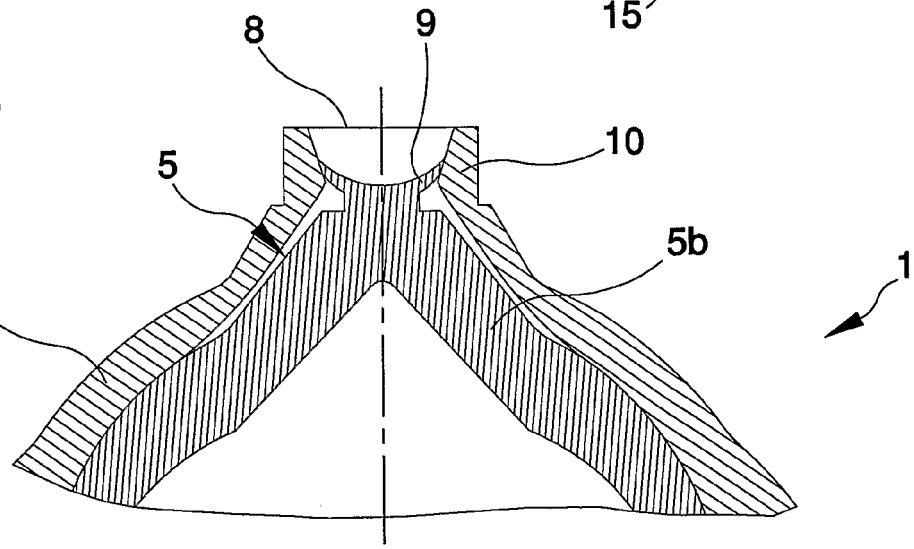

BOTTLE FOR CONTAINING FLUIDS, PARTICULARLY FOR PHARMACEUTICAL PRODUCTS OR THE LIKE

BACKGROUND OF THE INVENTION

1. Field of the Invention

This invention relates to a bottle for containing fluids, particularly pharmaceutical products or the like.

2. The Prior Art

The use of preserving agents added to products is well known, such as medicinal and pharmaceutical fluids contained in multidose bottles, the purpose being to prevent alteration and bacterial contamination of the contents once the bottles have been opened due to contact with the external environment.

Considering the fact that the use of such preserving agents is limited and regulated by strict laws, the integrity of the products is guaranteed and only the structure of the bottles is modified.

For example, single-dose bottles are known which, as such, are used just once so they do not require the addition of a preserving agent.

However, even these single-dose bottles are not without drawbacks, one of them being their bulk, with an equal volume of product contained in them, plus a lot of material is wasted and manufacturing costs are higher compared to multi-dose bottles.

As an alternative to single-dose bottles, multi-dose bottles are known that are basically composed of a fluid container made of a deformable material and which is fitted with a mouth to which a fluid dispensing spout is connected. The structure of the spout permits a unidirectional flow of the fluid from the container outwards and prevents polluting substances which are found in the environment external from entering the container.

The spout does, in fact, comprise a valve, made of an elastically deformable material, which is connected to the container's mouth and which features a plurality of gaps through which the fluid can flow, and a cap made in a basically stiff material which fits on and seals the valve and which has a dispensing opening at the top.

By squeezing the container, the fluid is pushed towards the spout where it compresses the valve radially and comes through into the space that opens between the valve and the cap until it reaches the cap's dispensing opening. These multi-dose bottles of the known type do, however, have some drawbacks, among which the fact that the time the valve takes to return to its original configuration (not deformed) is not negligible, which makes the formation of fluid residual easy as well as the entry of external pollutants.

To this end, moreover, it must be noted that traditional bottles do not guarantee correct dispensing of the fluid; the way the valve is deformed due to the squeezing pressure exerted on it by the fluid as it is being dispensed does, in fact, tend to be concentrated at the bottom, by the container's mouth, which is where a collecting pocket forms as a result.

Fluid stagnates inside this collecting pocket, losing the thrust necessary to deform the upper portion of the valve so failing to reach the dispensing opening when squeezing is finished.

In addition, in the known bottles, correct dispensing of the fluid is hindered also by the fact that the gap in the coupling between the valve and cap in proximity of the dispensing opening tends to get smaller.

The primary aim of this invention is to design a bottle for containing fluids, particularly pharmaceutical products or the like, that permits a reduction in the time it takes for the valve to return to its original configuration, thus reducing the formation of fluid residuals and the possibility of external pollutants from entering as well as ensuring a correct and constant dispensing of the fluid.

Within the sphere of this technical aim, another purpose of this invention is to cater to the above aims with a simple structure, of relatively practical implementation, safe to use and with effective operation, as well as having a relatively low cost.

SUMMARY OF THE INVENTION

This aim and these purposes are all achieved by this bottle for containing fluids, particularly pharmaceutical products or the like, which includes a fluid container made of a deformable material and which features a mouth for the passage of the fluid, a valve of an elastically deformable material that defines a flexible inner chamber arranged in proximity to the mouth, and a cap that substantially fits on and seals the valve and which has a dispensing opening for dispensing the fluid, the squeezing of the container causing the fluid to push up towards the mouth, the valve to compress, the fluid to flow between the valve and cap and to come out through the dispensing opening, and which includes a containment ring placed between said cap and the valve, arranged so that it externally embraces at least one portion of the valve and able to limit its deformation.

Further characteristics and advantages of this invention will appear even more evident from the detailed description of some preferred, but not exclusive, forms of embodiment of a bottle for containing fluids, particularly pharmaceutical products or the like, illustrated indicatively by way of non limiting example, in the attached drawings.

BRIEF DESCRIPTION OF THE DRAWINGS

FIG. 2 is an exploded view of a portion of the bottle of FIG. 1;

FIG. 3 is a sectional view, on an enlarged scale, of a detail of the bottle of FIG. 1;

DETAILED DESCRIPTION OF THE PREFERRED EMBODIMENTS

Figure 1:
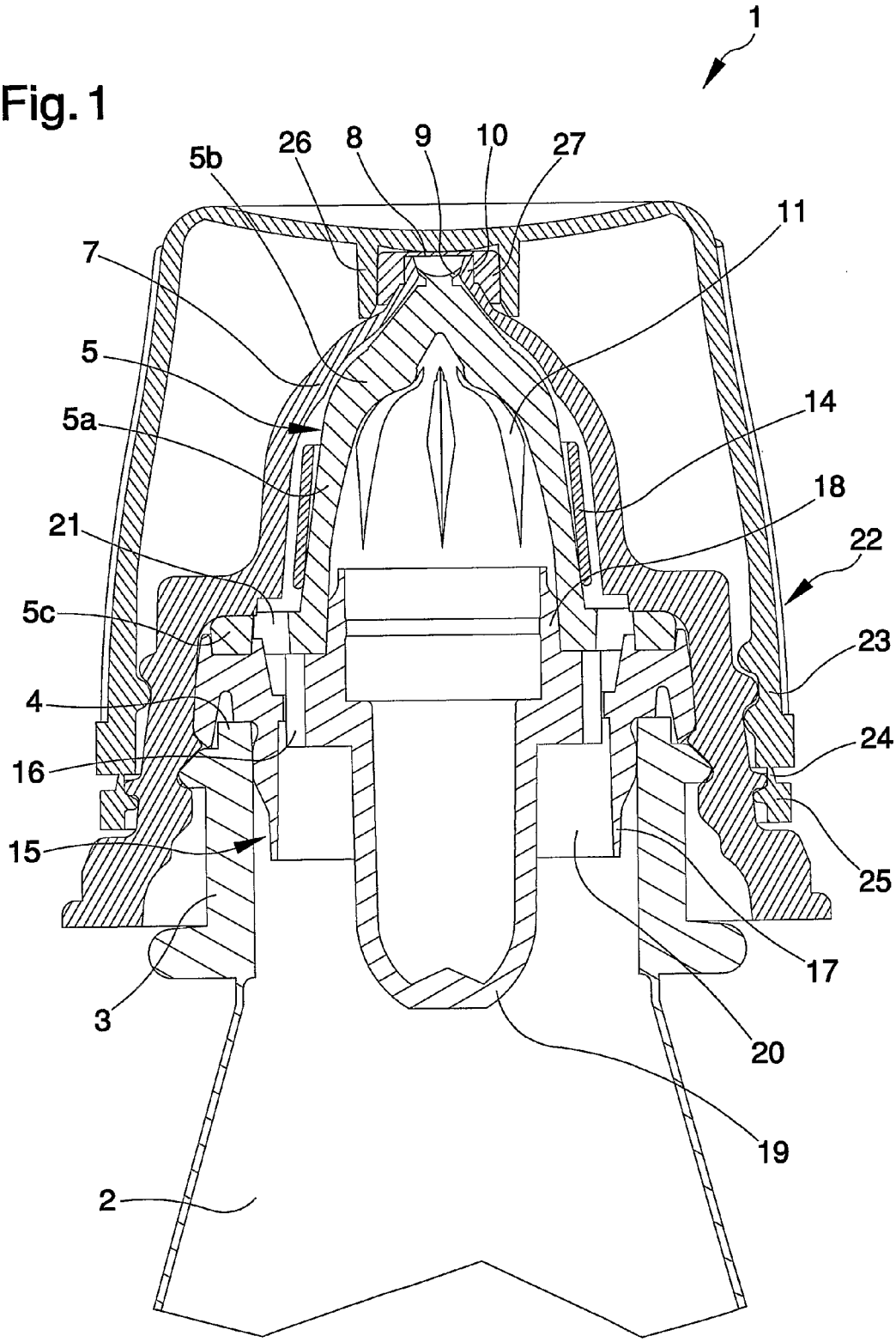
FIG. 1 is a schematic and partial sectional view of a first form of embodiment of the bottle according to the invention.

With special reference to such figures, a bottle for containing fluids, particularly pharmaceutical products or the like, has been globally designated by reference number 1.

The bottle 1 comprises a container 2 of a fluid which is only illustrated partially in the figures.

The container 2 is made of a deformable material and extends to form a neck 3 at the top of which a mouth 4 for the passage of the fluid.

In proximity to the mouth 4 is located a valve 5, made of an elastically deformable material, which defines a flexible inner chamber 6.

The valve 5 is bell shaped and features a first open section 5*a*, substantially tubular in shape, and a second closed section 5*b*.

On the valve 5 is fitted and sealed a cap 7, made of a stiff material, whose base is coupled to the neck 3 of the container 2 on the top of which a fluid dispensing opening 8 is obtained in axial position.

In actual fact, by squeezing the container 2 the fluid is pushed towards the mouth 4, the second section 5*b* of the valve 5 is compressed, the fluid flows between the valve 5 and the cap 7 and the latter comes out through the dispensing opening 8.

Usefully, a check valve body 9 is defined in proximity to the dispensing opening 8, its task being to allow the fluid to flow from the container 2 outwards and to prevent it coming back.

In detail, the check valve body 9 consists of a disc of an elastically deformable material that is connected to the end of the second section 5*b* of the valve 5 and which rests on a seat 10 defined in proximity of the dispensing opening 8.

The seat 10 is defined downstream from the dispensing opening 8, in the direction in which the fluid flows out from the container 2 and has a truncated cone shape, diverging outwards so the disc 9, resting on it, curves with its concavity facing outwards (FIG. 3).

In actual fact the check valve body 9 ensures the fluid is sealed inside the container 2 and keeps it in perfect condition, preventing it from leaking accidentally, preventing fluid residuals from accumulating by the dispensing opening 8 and the entry of any external pollutants inside the container 2.

The valve 5 has a plurality of first longitudinal ribs 11 which are defined in relief on the inner side surface of the second section 5*b* of the valve 5.

When the container 2 is no longer being squeezed, the first longitudinal ribs 11 help the valve return to its original non-deformed configuration, especially its second section 5*b*.

The valve 5 also has a plurality of second longitudinal ribs 12 which are defined in relief on the outer side surface of the second section 5*b*.

Between two successive second longitudinal ribs 12 is a bed 13 for the passage of fluid; the second longitudinal ribs 12 guarantee opening of the beds 13 even if the clearance of the coupling between the valve 5 and the cap 7 in proximity of the dispensing opening 8 tends to get smaller.

Advantageously, a containment ring 14 is inserted between the valve 5 and the cap 7, substantially coaxial to them, so it externally embraces the first section 5*a* of the valve 5 and limits its deformation.

With the compression action exerted by the fluid as it leaves the container, the containment ring 14 reduces squeezing of the first section 5*a*, concentrating it on the second section 5*b* of the valve 5, thus preventing the fluid from stagnating and guaranteeing correct dispensing.

The bottle 1 comprises supporting and closing means 15 for supporting the valve 5 and for sealing the inner chamber 6, that are connected to the cap 7 and container 2.

In the particular form of embodiment of the invention illustrated in FIGS. 1 to 3, the supporting and closing means are composed of a sealing element placed in between the mouth 4 and valve 5.

The sealing element 15 features a plurality of holes 16 for the passage of fluid, an inner ring-shaped projection 17 that faces the container 2 for coupling to the mouth 4, an outer ring-shaped projection 18, facing the valve 5 to couple and seal the inner surface of the first section 5*a* of the valve 5, and a peduncle 19 that extends inside the inner ring-shaped projection 17.

The ring-shaped projections, inner 17 and outer 18, and the peduncle 19 are defined substantially coaxial to one another; a guiding space 20 for the fluid leaving the container 2 is located between the peduncle 19 and the inner ring-shaped projection 17.

In addition, in the form of embodiment of the invention illustrated in FIGS. 1 to 3 the valve 5 has a ring-shaped flap 5*c* that extends around the open end of the first section 5*a* and features a plurality of fluid passage gaps 21.

In practice, after the bottle 1 has been squeezed, the fluid coming from the container 2 through the holes 16 of the sealing element 15 goes through the passage gaps 21 entering the compartment defined between the outer surface of the valve 5 and the inner surface of the cap 7.

Furthermore, in this particular form of embodiment, the bottle 1 is fitted with a closing plug 22 that consists of a hollow cylindrical body 23 that fits on the cap 7 and which is connected along a plurality of frangible portions 24 to a sealing ring nut 25 connected to the cap 7 or container 2.

An internal appendix 26 is obtained inside the closing plug 22 which, in the closing configuration, fits on the cap 7 by the edge of the dispensing opening 8. Sealing means are also housed inside the internal appendix 26, of the bearing type 27, made in a deformable material that rests against the edge of the dispensing opening 8 when the closing plug 22 is fitted on the cap 7.

Figure 4:
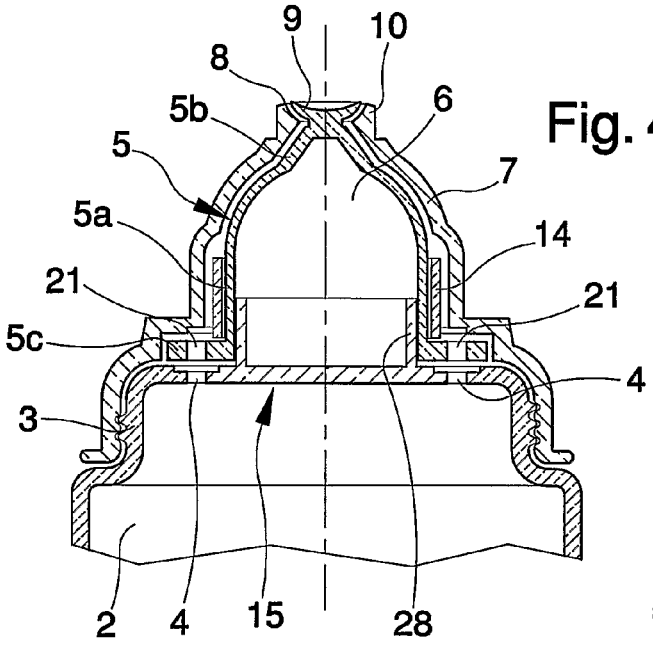
FIG. 4 is a schematic and partial sectional view of a second form of embodiment of the bottle according to the invention.

In an alternative form of embodiment of the invention, represented in FIG. 4, the supporting and closing means 15 consist of a transversal wall of the neck 3 of the container 2 and the mouth 4 is defined by a plurality of through slots created on the wall 15.

The wall 15 features a ring-shaped relief 28 facing the valve 5 which, similar to the outer ring-shaped projection 18 which we find in the first form of embodiment illustrated previously, is able to couple with and seal the inner surface of the first section 5*a* of the valve 5.

For the rest, the form of embodiment illustrated in FIG. 4 is fitted with a valve 5 and a containment ring 14 similar to those shown in FIGS. 1 to 3.

In particular, both in the first and second form of embodiment, the containment ring 14 is a body separate from the supporting and closing means 15.

However, different construction solutions are possible where the containment ring 14 is integrally associated with the supporting and closing means 15.

Figure 5:
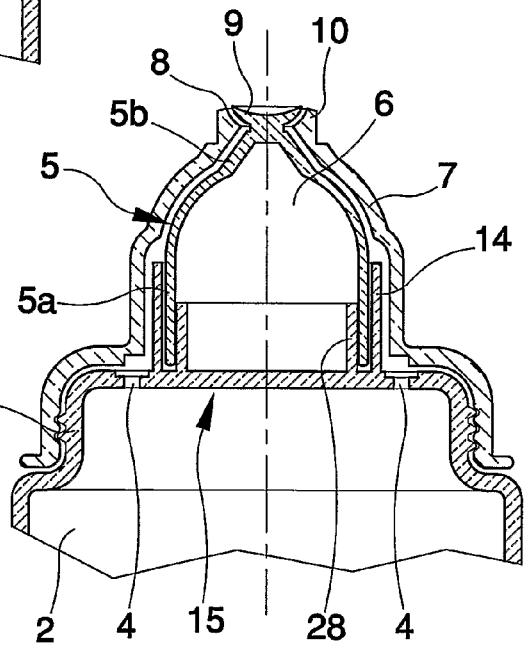
FIG. 5 is a schematic and partial sectional view of a third form of embodiment of the bottle according to the invention.

In FIG. 5, for example, a third form of embodiment of the invention is illustrated where the supporting and closing means 15 consist of a transversal wall similar to the one in FIG. 4.

The containment ring 14 is made in one piece with this wall and it extends around the ring-shaped relief 28.

In addition, unlike the previously described forms of embodiment, the valve 5 has no ring-shaped flap 5*c* and the first section 5*a* is housed in the space defined between the containment ring 14 and the ring-shaped relief 28.

Other forms of embodiment are, however, possible, not illustrated in the figures, wherein, for example, the bottle 1 has a sealing element similar to the one in FIGS. 1 to 3 and it is also fitted with a containment ring, connected integrally to it, around the outer ring-shaped projection; in this case, the valve has no ring-shaped flap, the same as FIG. 5, and is inserted between the containment ring and the outer ring-shaped projection.

Figure 6:
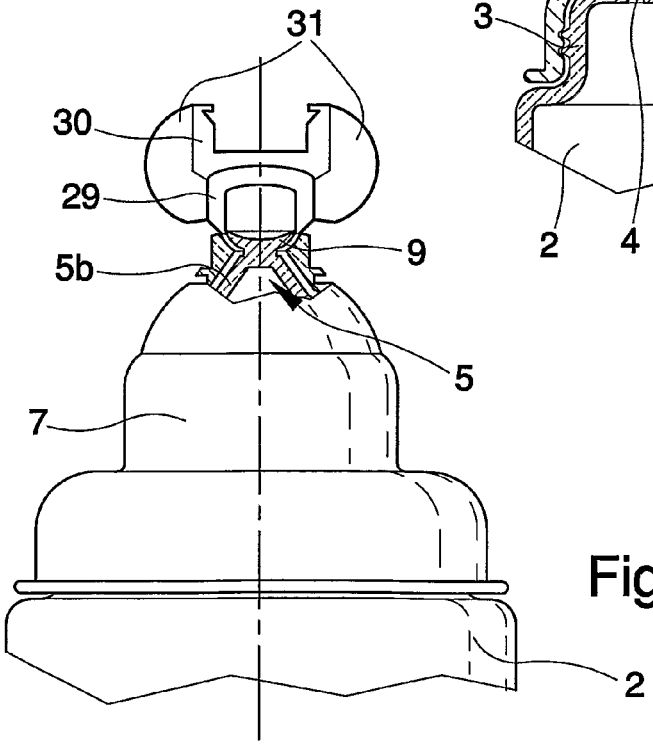
FIG. 6 is a schematic and partial sectional view of a fourth form of embodiment of the bottle according to the invention.

In a last form of embodiment of the invention illustrated in FIG. 6, the closing plug 22 is connected to cap 7 along a plurality of breaking lines 29 which allow joining to the edge of the dispensing opening 8 when the bottle 1 is being prepared.

In addition, the closing plug 22 also has a top 30 that, once breaking lines 29 have been broken, can be fitted on the edge of the dispensing opening 8 and removed when wanted; two or more gripping fins 31 projecting from the sides of the top 30 allow for a firmer grip of the plug with your hand.

It has in practice been seen how the described invention achieves the intended purposes.

The invention thus conceived is susceptible of numerous modifications and variations, all of which falling within the scope of the inventive concept.

Furthermore all the details may be replaced by other elements which are technically equivalent.

In practice, all the materials used, as well as the contingent shapes and dimensions, may be any according to requirements without because of this moving outside the protection scope of the following claims.

The invention claimed is:

1. A bottle for containing fluids, comprising;

a fluid container made of a deformable material and which includes a mouth for passage of said fluid, a valve of an elastically deformable material that defines a flexible inner chamber arranged in proximity of said mouth, a cap that substantially fits on and seals said valve and which has a dispensing opening for dispensing said fluid and a seat downstream of said dispensing opening, the squeezing of the container causing fluid therein to push up towards the mouth, the valve to compress, the fluid to flow between the valve and cap and to come out through said dispensing opening, a containment ring placed between said cap and said valve and arranged to externally embrace at least one portion of said valve and able to limit deformation thereof, and a check valve body attached to said valve and which extends through said dispensing opening and includes a disc which can contact said seat to close said discharge opening.

2. The bottle according to claim 1, wherein said valve is bell shaped and includes a first wide section substantially tubular in shape, and a second tapered section which can be positioned in proximity to said dispensing opening.

3. The bottle according to claim 2, wherein said containment ring is arranged to externally embrace said first section.

4. The bottle according to claim 1, including supporting and closing means for supporting said valve and for closing said inner chamber, which can be associated with at least one between said cap and said container.

5. The bottle according to claim 4, wherein said containment ring is a body separate from said supporting and closing means.

6. The bottle according to claim 4, wherein said containment ring is one piece with said supporting and closing means.

7. The bottle according to claim 4, wherein said supporting and closing means comprise at least one sealing element placed in between said mouth and said valve and includes at least one hole for the passage of the fluid.

8. The bottle according to claim 7, wherein said sealing element comprises an inner ring-shaped projection facing said container and able to couple to said container's mouth.

9. The bottle according to claim 7, wherein said sealing element comprises an outer ring-shaped projection facing said valve and able to couple to and seal the inner surface of said first valve section.

10. The bottle according to claim 8, wherein said sealing element comprises a peduncle that extends inside said inner ring-shaped projection, between said peduncle and said inner ring-shaped projection being defined a guiding space for the fluid leaving the container.

11. The bottle according to claim 7, wherein said sealing element comprises:

an inner ring-shaped projection facing said container and able to couple to said container's mouth;

an outer ring-shaped projection facing said valve and able to couple to and seal the inner surface of said first valve section; and a peduncle that extends inside said inner ring-shaped projection between said peduncle and said inner ring-shaped projection being defined a guiding space for the fluid leaving the container;

said inner ring-shaped projection, said outer ring-shaped projection and said peduncle being defined substantially coaxial to one another.

12. The bottle according to claim 9, wherein:

said valve is bell shaped and features a first open section, substantially tubular in shape, and a second closed section which can be positioned in proximity of said dispensing opening; and said containment ring is integrally associated with said sealing element and extends substantially around said outer ring-shaped projection, a housing space of said first valve section being defined between said containment ring and said outer ring-shaped projection.

13. The bottle according to claim 4, wherein said supporting and closing means comprise at least one wall of said container, said mouth being defined by at least one through slot obtained on said wall.

14. The bottle according to claim 13, wherein:

said valve is bell shaped and includes a first open section, substantially tubular in shape, and a second closed section which can be positioned in proximity to said dispensing opening; and said wall comprises a ring-shaped relief, facing said valve and able to couple to and seal the inner surface of said first section of the valve.

15. The bottle according to claim 14, wherein said containment ring is integrally associated with said wall and extends substantially around said ring-shaped relief, a housing space of said first valve section being defined between said containment ring and said ring-shaped relief.

16. The bottle according to claim 2, wherein said valve comprises a ring-shaped flap which extends around the open end of said first section and features at least one fluid passage gap.

17. The bottle according to claim 2, wherein said second valve section comprises a plurality of first longitudinal ribs obtained in relief on the inner side surface of said second section of the valve.

18. The bottle according to claim 2, wherein said second valve section comprises a plurality of second longitudinal ribs obtained in relief on the outer side surface of said second section, a bed for the passage of said fluid being defined between two successive second ribs.

19. The bottle according to claim 1, including a closing plug which can be associated with said cap.

20. The bottle according to claim 19, wherein said closing plug comprises a substantially hollow cylindrical body, able to be fitted around said cap.

21. The bottle according to claim 19, wherein said closing plug comprises an internal appendix which, in the closing configuration, fits on said cap by the edge of said dispensing opening.

22. The bottle according to claim 19, wherein said closing plug comprises sealing means, which can be associated with the inner surface of the plug and able to rest against the edge of said dispensing opening in the closing configuration.

23. The bottle according to claim 19, wherein said closing plug comprises:

an internal appendix which, in the closing configuration, fits on said cap by the edge of said dispensing opening; and sealing means, which can be associated with the inner surface of the plug, are able to rest against the edge of said dispensing opening in the closing configuration, and comprise a bearing in a deformable material housed in said internal appendix.

24. The bottle according to claim 19, wherein said closing plug is associated along a plurality of frangible portions with a sealing ring nut integral to said cap or said container.

25. The bottle according to claim 19, wherein said closing plug is associated with said cap along a plurality of breaking lines.

26. The bottle according to claim 19, wherein said closing plug comprises a top that can be connected, in a removable way, to the edge of said dispensing opening.

27. The bottle according to claim 1, wherein said seat has a truncated cone shape, diverging outwards.

28. The bottle according to claim 1, wherein said dispensing opening is defined substantially axial to said cap.

29. The bottle according to claim 1, wherein said valve seat has a truncated cone shape and said disc has an outwardly concave curvature.

* * * * *

UNITED STATES PATENT AND TRADEMARK OFFICE

CERTIFICATE OF CORRECTION

PATENT NO. : 8,408,433 B2
APPLICATION NO. : 12/309808
DATED : April 2, 2013
INVENTOR(S) : Antonio Fontana It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1038 days.

Signed and Sealed this
First Day of September, 2015

Michelle K. Lee

Michelle K. Lee
*Director of the United States Patent and Trademark Office*